United States Patent [19]

Dennhardt

[11] 4,453,708

[45] * Jun. 12, 1984

[54] MECHANISM FOR TRANSPORTING AND POSITIONING PRINTING MASTERS

[75] Inventor: Werner Dennhardt, Bad Kreuznach, Fed. Rep. of Germany

[73] Assignee: Hoechst Aktiengesellschaft, Frankfurt am Main, Fed. Rep. of Germany

[ * ] Notice: The portion of the term of this patent subsequent to Mar. 1, 2000 has been disclaimed.

[21] Appl. No.: 326,476

[22] Filed: Dec. 2, 1981

[30] Foreign Application Priority Data

Dec. 15, 1980 [DE] Fed. Rep. of Germany ..... 3047178

[51] Int. Cl.[3] ..... B65H 1/02

[52] U.S. Cl. ..... 271/8 A; 101/419; 271/15; 271/20; 271/21; 271/30 A; 271/98; 271/162; 271/225; 271/240

[58] Field of Search ..... 271/8 A, 11, 15, 20, 271/98, 102, 30 A, 240, 268, 21, 225, 162; 101/419

[56] References Cited

U.S. PATENT DOCUMENTS

| | | | |
|---|---|---|---|
| 3,810,612 | 5/1974 | McCahon | 271/11 |
| 4,149,798 | 4/1979 | McGowan et al. . | |
| 4,375,285 | 3/1983 | Dennhardt | 271/15 X |

FOREIGN PATENT DOCUMENTS 2462216 7/1977 Fed. Rep. of Germany .

*Primary Examiner*—Richard A. Schacher

*Attorney, Agent, or Firm*—Schwartz, Jeffery, Schwaab, Mack, Blumenthal & Koch

[57] ABSTRACT

A mechanism for transporting and positioning printing plates in a processing unit comprising a plate holder for storing printing plates which are to be transported to an exposure table, said plate holder being pivotable between a horizontal position and a vertical position and abutting a pair of roller guides when it is in its vertical position, a horizontally displaceable suction means for grasping the foremost printing plate of a supply of plates in the plate holder by its uncoated reverse side, and for transporting the printing plate to a position above a gripping device, and opposed positioning means arranged above this gripping device, at least one of these positioning means being displaceable toward the other to position and maintain a printing plate in a predetermined desired position.

14 Claims, 3 Drawing Figures

MECHANISM FOR TRANSPORTING AND POSITIONING PRINTING MASTERS

BACKGROUND OF THE INVENTION

The present invention relates to a mechanism for transporting and positioning printing masters in a processing unit, in which the printing masters are transported from a plate holder to an exposure table.

Lettered and imaged printing masters which are directly suitable for printing are manufactured in such a way that the printing plates are first electrostatically charged and then an original is projected imagewise upon the individual plate. After this exposing procedure, the printing master is developed with a developer, fixed and decoated. It is then ready for use in a printing press.

German Pat. No. 2,462,216 discloses an apparatus for the manufacture of printing masters by electrophotographic means, in which the individual printing plate is picked up from a stack in a plate holder by a transport device comprising a transport carriage with reduced pressure-suction means. The transport carriage transfers the printing plate to an exposure platform. Charging of the individual printing plate and transporting of the plate to the exposure platform are combined in a time-saving manner by mounting a corona charging-station for electrostatic charging of the printing plates at the front of the transport carriage. The corona charging-station extends transversely to the direction of motion of the carriage. The carriage has a vacuum plate which is attached to its underside and which is connected with a vacuum pump by a number of holes. When the transport carriage is placed on top of the uppermost printing plate in the plate holder, reduced pressure is generated and the printing plate is drawn by suction to the vacuum plate. The transport carriage is then displaced by means of a motor along two guide rails toward the exposure platform. As soon as the carriage has reached its position above the exposure platform, it is lowered. The reduced pressure in the vacuum plate is then released so that the printing plate is set down on the exposure platform. The exposure platform is also designed as a vacuum plate and, under the action of reduced pressure, the printing plate is firmly urged against the platform.

In this known apparatus, the photoconductive, coated side of the printing plate is contacted by the suction means when the individual plate is lifted from the stack. Although these suction means allow a far gentler transport of the printing plate as compared to conventionally used rollers or webs which are guided over the coated side of the plate, mechanical or physical defects caused by the suction means can still occur on the developed printing master.

U.S. Pat. No. 4,149,798 discloses a transport station for printing masters, which includes a stacking area containing a supply of printing masters. A paper disposal area is provided for the sheets of paper which are interposed between the individual masters in the stack. The printing masters are transported from the stacking area to a conveyor by means of a control mechanism equipped with a number of suction cups. The control mechanism is pivotally attached to a support arm which is connected to a motor via a gear mechanism. Thus, the control mechanism is adapted to perform a lateral sliding movement back and forth. The uppermost printing plate in the stack is picked up by at least four suction cups of the control mechanism. Then the control mechanism swings upwardly and, at the same time, the support arm mechanically approaches the conveyor. When the reduced pressure in the suction cups is released, the control mechanism pivots downwardly and deposits the printing master on the conveyor. A second control mechanism positioned above the sheet of paper lying between the two printing plates, engages the sheet, picks it up and conveys it to the paper disposal area. The conveyor transports the printing plates to an exposure platform which has a plurality of holes on its upper surface and which comprises a lower chamber connected to a vacuum pump by a vacuum line. When the printing plate has been positioned on the surface of the exposure platform, reduced pressure is applied and the plate is thus retained on the platform. Just as in the first-mentioned apparatus, the photoconductive layer of the printing plate is contacted by suction means when the uppermost plate is removed from the stack, and this may lead to mechanical or physical defects on the finished printing master.

In the prior art processing units, in which the printing plates are horizontally removed from a plate holder by a suction means and are transported to and lowered upon an exposure table, the position of the printing plate is usually not adjusted before it lies on the exposure table. This may lead to difficulties, if printing plates of different formats are used, since the suction means which is moved along a fixed path will invariably pick up the printing plates at the same points, irrespective of the plate format. A printing plate varying from the DIN A4 size, for example, is not held by suction along its center line. As a result, it may be difficult to position the printing plate after it has been put down on the exposure table, because different stops must be provided for varying formats.

SUMMARY OF THE INVENTION

Accordingly, it is the object of the present invention to provide an improved mechanism for positioning and transporting printing masters in a processing unit.

A further object of the present invention is to provide an improved mechanism for transporting and positioning printing masters which is adapted to handle plates standing on edge in a vertically oriented magazine.

It is also an object of the present invention to provide an improved mechanism for transporting and positioning printing masters which enables rapid processing of a series of printing masters.

Another object of the present invention is to provide a mechanism for transporting and positioning printing masters which avoids mechanical contact with the photosensitive coating on the working side of the plates.

An additional object of the present invention is to provide a mechanism for transporting and positioning printing masters which has a reduced tendency to introduce defects in the printing plates.

Yet another object of the present invention is to provide a mechanism for transporting and positioning printing masters which is readily adaptable to various sizes and formats of printing plates.

A still further object of the present invention is to provide a mechanism for transporting and positioning printing masters which enables precise positioning of printing plates on an exposure table.

These and other objects of the invention are achieved by providing a mechanism for positioning and transporting printing masters from a plate holder to an exposure table in a processing unit, which mechanism comprises means for holding a supply of plates, said holding means being pivotable to a vertical position, roller guide means abutting said holding means when said holding means is in said vertical position, suction means for grasping the foremost plate of a supply of plates in said holding means, said suction means being horizontally displaceable in order to transport a grasped printing plate along a transport path, means disposed below said transport path for gripping a printing plate, and a pair of opposed positioning means disposed above said gripping means for positioning and maintaining a printing plate in a predetermined position, at least one of said positioning means being laterally displaceable toward the other of said positioning means.

In one preferred embodiment of the invention, the plate holder can be pivoted about a swivel shaft from the horizontal to the vertical position. The two roller guides are appropriately resiliently mounted and rest against the foremost printing plate in the plate holder, close to the lower and upper edges of the vertically oriented plate holder. Each roller guide comprises mutually spaced rollers which are mounted on a common shaft. A motor is connected to the shaft and drives it.

In a further preferred embodiment of the invention, the gripping device has a gripper mechanism with a V-shaped opening and is coupled to a rotary magnet via a clutch. The rotary magnet rotates the gripping device from the vertical to the horizontal position and back to the vertical position again.

The mechanism of the invention has the advantage that the upstanding printing plate is positioned very accurately in two directions (X and Y coordinates). Thereafter, the printing plate is seized by the gripping device which swivels it to the horizontal position and conveys it to the exposure table, where it assumes its final position. On the exposure table, suction is applied and the plate is thus firmly retained.

BRIEF DESCRIPTION OF THE DRAWINGS

The invention will be described in further detail with reference to the accompanying drawings wherein.

DETAILED DESCRIPTION OF A PREFERRED EMBODIMENT

To move printing plates of different sizes into the desired position for exposure, regardless of the format concerned in each case, each individual printing plate is removed from a vertically oriented plate holder or magazine in which the plates are standing on edge. The removed plate then must be positioned in two mutually perpendicular directions and rotated to a horizontal position with the photosensitive layer of the plate facing upwardly for transport to the exposure table. The manipulation of the plates should be effected without mechanically contacting the photosensitive layer during the transport from the plate holder to the exposure table.

In accordance with the invention, a mechanism is provided wherein printing masters, e.g. printing plates, are stored in a pivotable plate holder or magazine which abuts roller guides when the plate holder is in a vertical position. A suction means is provided which grasps the foremost printing plate in the plate holder by the uncoated back or reverse side of the plate; said suction means being horizontally displaceable for transporting the printing plate along a transport path. A gripping device is arranged underneath the transport path of the printing plate. Above the gripping device there is provided a pair of opposed positioning means, at least one of said positioning means being adapted to be displaced in the direction of the other positioning means in order to position and maintain the printing plate in a predetermined position.

Figure 1:
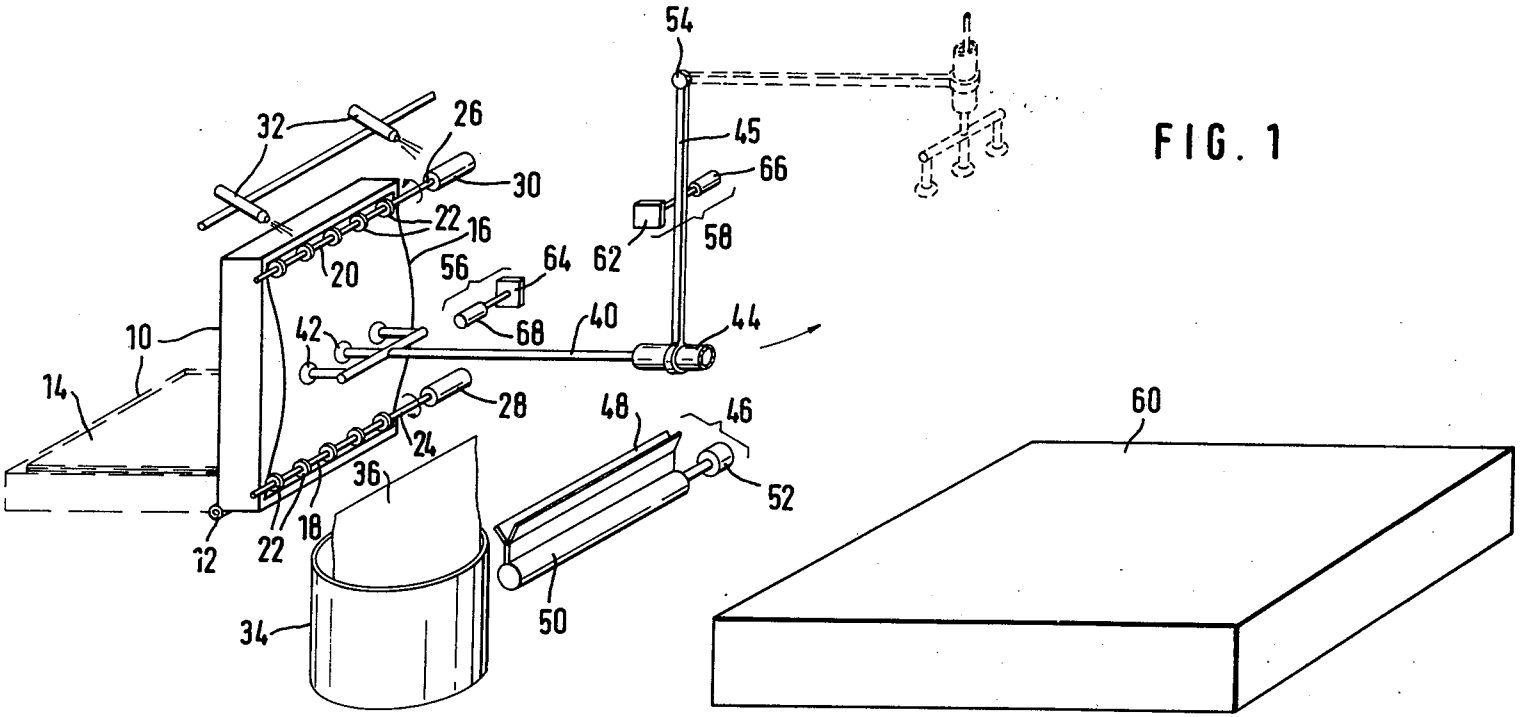
FIG. 1 is a diagrammatic representation of the removal of a printing plate from the plate holder, using a suction means.
Figure 2:
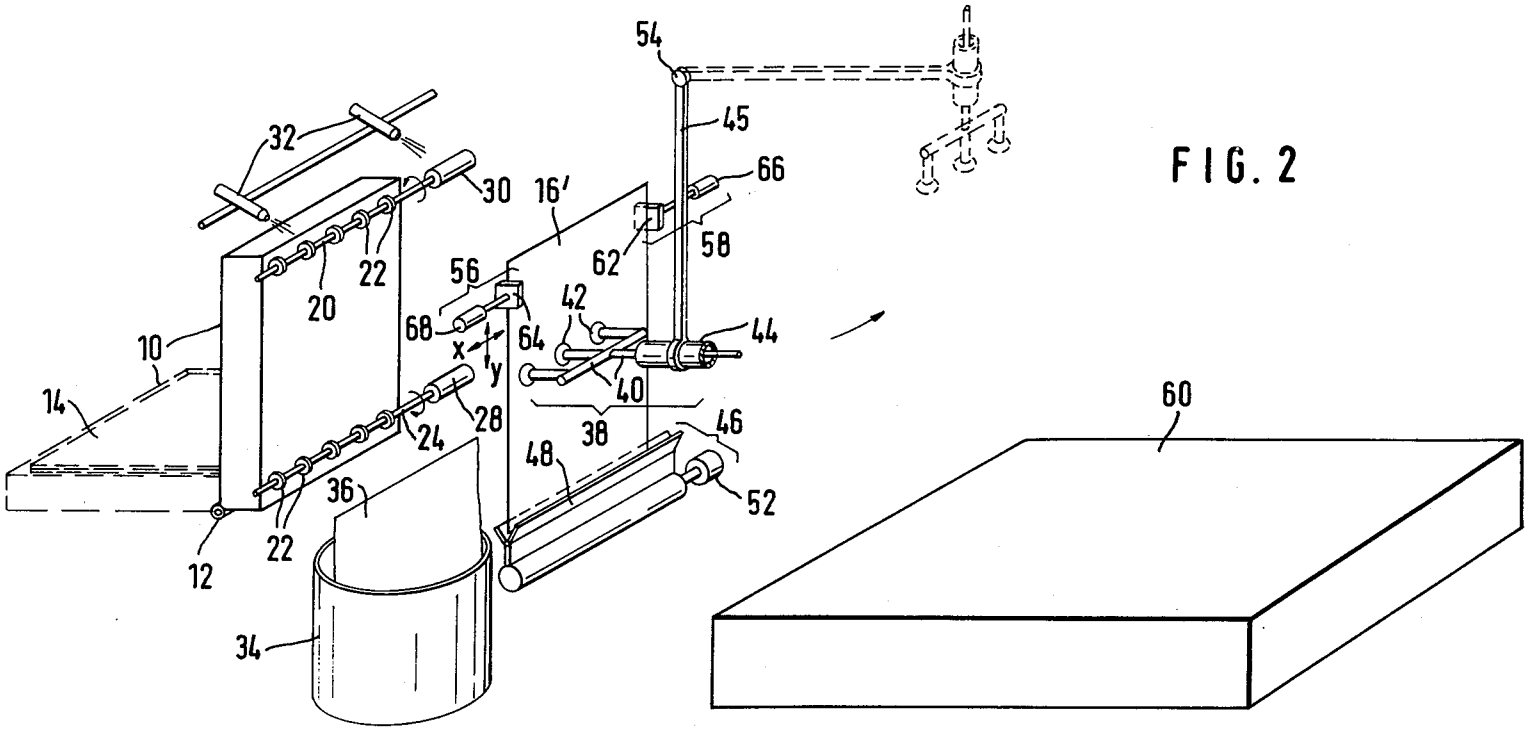
FIG. 2 is a diagrammatic representation which shows the positioning of the printing plate with the aid of positioning means arranged above a gripping device.
Figure 3:
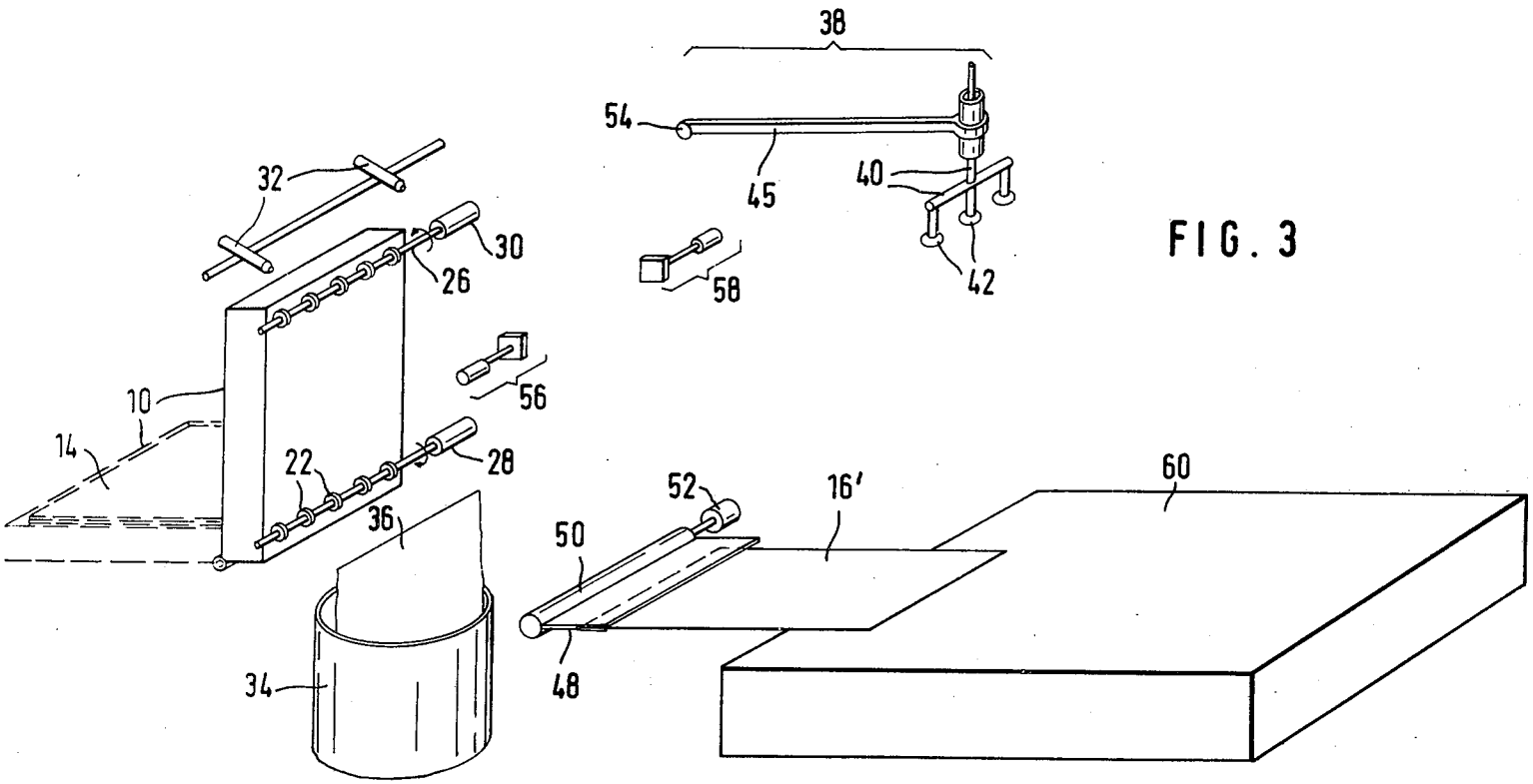
FIG. 3 is a diagrammatic representation which shows the gripping device which has been swivelled to the horizontal position together with the printing plate, for transporting the plate towards the exposure table.

Referring now to FIGS. 1 to 3, the individual stages of operation of an illustrative mechanism for transporting and positioning printing plates in a processing unit are described. A pivotable plate holder 10 for storing the printing plates 16 is rotated about a shaft 12 to the horizontal position and a stack of printing plates 14 is put in. The printing plates 16 are maintained in the plate holder with their photoconductive, light-sensitive layer facing downward, and, consequently, premature exposure of the plates as a result of incident light is largely prevented. The photosensitive layer of each printing plate 16 is protected from mechanical injuries by an interleaf 36, which usually is a sheet of paper. After insertion of the pile of printing plates 14, the plate holder 10 is pivoted to a vertical position where the foremost printing plate 16 rests against two roller guides 18 and 20. The two roller guides 18 and 20 are resiliently mounted and are, therefore, always in contact with the pile of printing plates 14 in the vertically oriented plate holder 10. Each of the roller guides 18 and 20 comprises a number of mutually spaced rollers 22 which are mounted on common shafts 24 and 26, resp. One of the roller guides 18 is arranged close to the lower edge of the vertically oriented plate holder 10, while the second roller guide 20 contacts the foremost printing plate 16 close to the upper edge of the plate holder 10.

The resiliently mounted shafts 24 and 26 of the roller guides 18 and 20 are connected with drive motors 28 and 30 which rotate in opposite directions with respect to each other. The opposite directions of rotation of the roller guides 18 and 20 assist in detaching the printing plate 16 from the pile of plates 14, with the aid of a suction means 38. This suction means 38 comprises a plurality of suction elements 42 which are attached to a piston rod 40. The piston rod 40 can be retracted into and extended from a lifting cylinder 44. The lifting cylinder 44 is fastened to one end of a rod 45 which is capable of being swivelled about a pivot 54 provided at its other end from the vertical to the horizontal position. The suction means 38, as a whole, is adapted to be moved horizontally between two positions. In one of these positions of the suction means, the suction elements 42 contact the uncoated reverse side of the foremost printing plate 16 in the plate holder 10. In the other position, as shown in FIG. 2, a printing plate 16' is held by the suction elements 42 above a gripping device 46.

Air nozzles 32 are arranged above the vertically oriented plate holder 10, and the jets of air which issue from these nozzles are directed obliquely against the upper edge of the foremost printing plate 16 in the plate holder 10. As soon as the upper and lower edges of printing plate 16, held by suction as shown in FIG. 1, have snapped out from under roller guides 18 and 20 as a result of a horizontal displacement of the suction means 38 toward an exposure table 60, the jets of air from the air nozzles 32 separate the interleaf 36 from the photoconductive layer of the printing plate 16 and convey it into a sheet disposal bin 34 positioned below the transport path of the printing plate 16. The opposite directions of rotation of the roller guides 18 and 20 have the effect that, after the printing plate 16 is pulled away from the pile of plates 14, the interleaf 36 is brushed away in the downward direction by the rollers 22 of the upper roller guide 20 and in the upward direction by the rollers 22 of the lower roller guide 18. At the same time, the opposite directions of rotation of the two roller guides assist in detaching the printing plate 16 from the pile of printing plates 14.

FIG. 2 shows the printing plate 16' which has been moved by the suction means 38 to a position above the gripping device 46. The gripping device 46 comprises a gripper mechanism 48 with a V-shaped opening and a rotary magnet 50 which is operated via a clutch 52. Depending upon whether the clutch 52 is energized or de-energized, the rotary magnet 50 rotates the gripping device 46 from the vertical to the horizontal position and back to the vertical position. Once the printing plate 16' is in the position indicated in FIG. 2, the reduced pressure in the suction elements 42 is released, and the printing plate 16', which until then had been held by suction, slides downwardly along the suction elements 42 and into the V-shaped opening of the gripper mechanism 48. Since the stream of air issuing from the air nozzles 32 simultaneously urges the printing plate 16' against the suction elements 42, the printing plate 16' is prevented from tipping over during this downward-sliding movement.

In the gripper mechanism 48, the printing plate 16' adjusts itself in the vertical direction by its own weight. To adjust the printing plate 16' in the horizontal direction, two positioning means 56 and 58 are arranged opposite to each other. These positioning means 56 and 58 make it possible electromechanically to approach any format chosen for the printing plate and also any central position of the printing plates so that the plate concerned is moved to the desired position, regardless of its format. Each positioning means 56 and 58 comprises a positioning plate 62 and 64, each of which is connected to a drive motor 66 and 68. The position of the individual positioning plate 62 or 64 is digitally preset in a known manner by appropriately controlling its motor 66 or 68. Depending on the preset value, the motor then shifts the positioning plate to a corresponding position. This can be achieved by first moving one of the positioning means 56 or 58 to its desired position, depending upon the format width of the printing plate 16'. In this position, said one positioning means acts as a stop for one of the edges of the upstanding printing plate 16'. Then the other positioning means is displaced in the direction of the positioning means which now constitutes the fixed stop, by actuating its motor, until said other positioning means abuts the edge of the printing plate 16' opposite the stop. As soon as this point is reached, a contact is established between the two positioning means through the printing plate 16'. This contact is a signal for the termination of the positioning procedure in the horizontal direction and, at the same time, triggers the closing movement of the gripper mechanism 48 which thus secures the printing plate 16' in its predetermined position. Rod 45 then swivels about the pivot 54 and swings the suction means 38 upwardly to the position indicated by broken lines in FIG. 2.

When the clutch 52 is energized, the rotary magnet 50 swivels the gripping device 46 from the horizontal to the vertical position. When the clutch 52 is de-energized, the gripping device 46 is again rotated from the vertical to the horizontal position by the rotary magnet 50, and during this procedure, the gripper mechanism 48 remains closed and firmly holds the printing plate 16'. Swivelling of the printing plate 16' is initiated by the jets of air from the air nozzles 32. As shown in FIG. 3, the gripping device 46 carrying the horizontally adjusted printing plate 16' can be displaced in the direction of the exposure table 60. A second, digital follow-up control (not shown) serves to move the printing plate 16' held by the gripper mechanism 48 into its final position on the exposure table 60 which is provided with a suction plate. In the final position, which can be digitally preset according to the format of the printing plate, the plate is drawn by suction to the exposure table and is thereby retained for exposure. After the gripper mechanism 48 has released the printing plate 16', it returns to its initial position and the rotary magnet 50 is actuated by energizing the clutch 52 so that the gripper mechanism 48 is rotated to its vertical position and is opened. The gripping device 46 is then ready to receive the next printing plate.

The suction means 38 is also returned from the position indicated by broken lines in FIG. 2 to the position in which the lifting cylinder 44 carrying the suction elements 42 is horizontally oriented and is ready to move towards the plate holder 10 for taking out another printing plate 16.

The foregoing embodiment has been described merely as an illustrative example of the invention and is not intended to be limiting. Since modifications of the described embodiment incorporating the spirit and substance of the invention may occur to persons skilled in the art, the scope of the invention is to be limited solely with respect to the appended claims and equivalents.

What is claimed is:

1. A mechanism for positioning and transporting printing masters from a plate holder means to an exposure table means in a processing unit, said mechanism comprising;

means for holding a supply of plates, said holding means being pivotable to a vertical position;

roller guide means abutting said holding means when said holding means is in said vertical position;

suction means for grasping the foremost plate of a supply of plates in said holding means, said suction means being horizontally displaceable in order to transport a grasped printing plate along a transport path;

means disposed below said transport path for gripping a printing plate; and a pair of opposed positioning means disposed above said gripping means for positioning and maintaining a printing plate in a predetermined position, at least one of said positioning means being laterally displaceable toward the other of said positioning means.

2. A mechanism according to claim 1, wherein said plate holder is attached to a swivel shaft and can be selectively pivoted about said shaft between a horizontal position and a vertical position.

3. A mechanism according to claim 1, wherein said roller guide means comprises two resiliently mounted roller guides which contact the foremost plate of a supply of plates in said holding means when said holding means is in the vertical position; one of said roller guides being disposed along the upper edge of the vertically positioned plate holder and the other of said roller guides being disposed along the lower edge of the vertically positioned plate holder.

4. A mechanism according to claim 3, wherein each roller guide comprises a plurality of mutually spaced rollers which are mounted on a common shaft and a drive motor operatively connected to said shaft for rotating said shaft.

5. A mechanism according to claim 4, wherein said two roller guides rotate in opposite directions with respect to each other.

6. A mechanism according to claim 1, wherein said suction means comprises a plurality of suction elements attached to the end of a piston rod which can be selectively retracted into or extended from a lifting cylinder.

7. A mechanism according to claim 6, wherein said cylinder is fastened to one end of a pivotable rod, said rod being selectively pivotable about a pivot at the end of said rod remote from said cylinder between a vertical position and a horizontal position.

8. A mechanism according to claim 1 further comprising air nozzle means disposed above said vertically oriented plate holder for directing a jet of air obliquely against the upper edge of the foremost plate of a supply of vertically oriented plates in said holding means.

9. A mechanism according to claim 8, wherein said air nozzle means comprises a plurality of air nozzles.

10. A mechanism according to claim 1, wherein said gripping means comprises a gripper mechanism with a V-shaped opening and means for selectively rotating said gripper mechanism between a vertical position and a horizontal position.

11. A mechanism according to claim 10, wherein said selective rotating means comprises a rotary magnet coupled to a clutch mechanism.

12. A mechanism according to claim 10, wherein said gripping device is horizontally displaceable toward the exposure table when said gripping device is in the horizontal position.

13. A mechanism according to claim 1, wherein each of said positioning means comprises a positioning plate and a digitally controlled motor operatively connected to said positioning plate for horizontally displacing said positioning plate to predetermined positions.

14. A mechanism according to claim 13, wherein one of the positioning means is first moved to a desired position to act as a stop for a vertical edge of an upright printing plate and the other positioning means is then displaced until the stop abuts one vertical edge of said upright printing plate and said other positioning means abuts the opposite vertical edge of the printing plate.

* * * * *